US005243917A

United States Patent [19]

Komstadius

[11] Patent Number: 5,243,917

[45] Date of Patent: Sep. 14, 1993

[54] PROJECTILE FOR THE DISPERSAL OF A LOAD IN THE FORM OF A PYROTECHNIC CHARGE

[76] Inventor: Sven Komstadius, Snäckstigen 2, S-582 58 Linkoping, Sweden

[21] Appl. No.: 861,783

[22] PCT Filed: Oct. 30, 1990

[86] PCT No.: PCT/SE90/00701

§ 371 Date: Jun. 16, 1992

§ 102(e) Date: Jun. 16, 1992

[87] PCT Pub. No.: WO91/07635

PCT Pub. Date: May 30, 1991

[30] Foreign Application Priority Data

Nov. 21, 1989 [SE] Sweden ..... 8903899

[51] Int. Cl.[5] ..... F24B 12/58

[52] U.S. Cl. ..... 102/489; 102/259; 102/334; 102/357

[58] Field of Search ..... 102/259, 334, 340, 342, 102/351, 357, 393, 489, 505

[56] References Cited

U.S. PATENT DOCUMENTS

| | | | |
|---|---|---|---|
| 3,576,165 | 4/1971 | Gawlick et al. | 102/259 |
| 3,623,432 | 11/1971 | Schminke | 102/259 |
| 3,712,224 | 1/1973 | Hanzel | 102/357 |
| 4,333,402 | 6/1982 | Landstrom et al. | 102/357 |

*Primary Examiner*—Harold J. Tudor

*Attorney, Agent, or Firm*—Lowe, Price, LeBlanc & Becker

[57] ABSTRACT

A projection for dispersing a pyrotechnic charge (10) is described. It comprises a first and a second pressure chamber (7,9) with a throttled gas connection (16) between them. A piston (8) expells the charge (10) out of its casing (2) when the gas pressure in the second pressure chamber (9) reaches a predetermined level. The projectile is characterized particularly by a third pressure chamber (18) in gas connection with the first pressure chamber (7) in the first piston (8). A second piston (20) provided with a striking pin (22) for activating an igniting element (11) for igniting the charge (10) is movable in the first piston (8). The second piston (20) is detended against movement by a first locking element (24) until this is released by the casing (2).

1 Claim, 1 Drawing Sheet

PROJECTILE FOR THE DISPERSAL OF A LOAD IN THE FORM OF A PYROTECHNIC CHARGE

Figure 1:
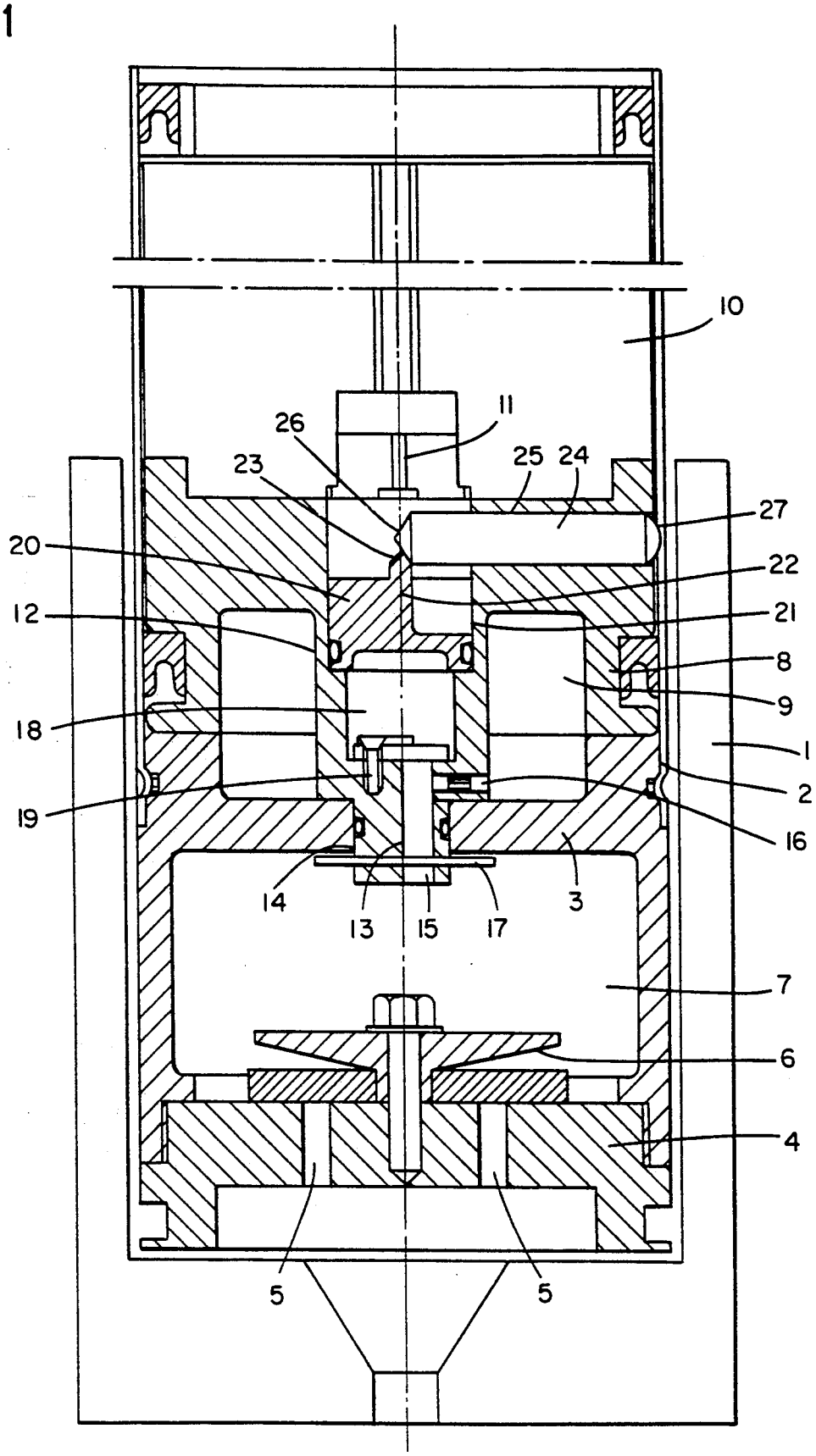

The present invention relates to a projectile for the dispersal of a load in the form of a pyrotechnic charge with a predetermined time delay after firing the projectile from a launching tube with gas under pressure. Such a projectile comprises a cylindrical casing with a first pressure chamber, formed by a portion of the casing together with a cross wall arranged in the casing and an external side wall, provided with at least one supply opening for the gas to the first pressure chamber. The projectile further comprises a second pressure chamber formed by a second portion of the casing, said cross wall and a piston axially movable with slide fitting in the casing, and the load, which stands in connection with the piston. A throttled gas connection is arranged between the first and second pressure chambers. The piston, under the effect of a pressure built up in the second pressure chamber, is arranged to perform an axial movement, pushing the load out of the casing, but not until the pressure has reached a predetermined level.

Such projectiles are known in principle, for instance from Swedish patent No. 7802120-1. In it there is an interlocking pin, which keeps said piston in a starting position, until the pressure in the second pressure chamber has reached a predetermined level, which is determined by the shearing resistance of the interlocking pin. This known projectile is, however, intended to fire and disperse a load consisting of a multiplicity of radarreflecting strips tightly packed in a casing.

The object of the present invention is to provide a projectile of the kind mentioned by way of introduction, which is suitable for reliable firing and ignition and thereby dispersal of a pyrotechnic charge. The projectile shall have a simple, reliable construction.

According to the invention such a projectile is characterized in that a third pressure chamber standing in connection with the first pressure chamber, is arranged in the first piston, formed by a barrel in which a second piston is arranged movable with slide fitting, provided with a striking pin intended to activate an igniting element for igniting a charge, a first locking element being arranged to detend the second piston against movement for as long as the movement of the first locking element is detended by a second locking element extending in the longitudinal direction of the projectile. The second piston is preferably arranged movable in the longitudinal direction of the projectile, but other constructions are conceivable within the scope of the invention. The first locking element is suitably formed as a dowel, movable in a barrel in the first piston, perpendicular to the longitudinal direction of the projectile and thereby of the piston. The second locking element consists in a preferred embodiment of the invention of the internal wall of the projectile casing.

The invention will now be described in more detail with reference to the accompanying figure, which shows, schematically, a longitudinal section of a projectile according to the invention.

In the figure a launching tube is designated by 1, a projectile casing by 2, a cross wall in the casing by 3 and an external side wall by 4. This is provided with two supply openings 5 for gas under pressure. A first check valve, designated by 6, is arranged to allow gas passage into but not out of a first pressure chamber 7, which is formed by the casing 2, the cross wall 3 and the side wall 4. A first piston 8 is arranged axially movable with slide fitting in the casing, the second pressure chamber 9 being formed by the casing 2, the cross wall 3 and the piston 8. A load in the form of a pyrotechnic charge is designated schematically by 10, with an igniting element 11. The first piston 8 is designed with a central, internal, axially directed circular-cylindrical portion 12, which with a portion 13 in the starting position of the piston extends through and is movable with slide fitting through a barrel 14 in the cross wall 3. In the portion 13 an axial channel 15 is arranged. This connects the first pressure chamber 7 with the second pressure chamber 9 via a throttled gas connection 16. The first piston 8 is kept in a starting position by a shear pin 17, whose shearing resistance is adapted so that not until the gas pressure in the second pressure chamber has risen up to a certain level does it allow the first piston with the load 10 to be shot out of the casing 2.

In the portion 12 a third pressure chamber 18 is arranged, via a second check valve 19 standing in connection with the channel 15 and thereby, in a starting position of the piston 8, with the first pressure chamber 7. The third pressure chamber 18 stands in direct connection with and is limited by a second piston 20, arranged movable with slide fitting in a central axial barrel 21 in the first piston 8.

The second piston 20, on its side turned away from the second pressure chamber 18 and facing the load 10, is provided with a centrally arranged striking pin 22, formed with a conical point 23. A first locking element 24 in the form of an elongated cylindrical dowel is arranged movable in a radially directed barrel 25 in the first piston 8. This dowel is rounded on its outward end 27. The dowel 24 is relatively easily movable in its barrel and with its conical point 26 detends the second piston 20 from moving in the axial direction by lying against the conical point 23 of the striking pin of the piston 20. The rounded end 27 of the dowel slides without mentionable resistance against the internal wall of the casing 2 on the axial movement of the second piston 8 along the casing.

The projectile works in the following way:

On firing from the launching tube 1 compressed gas, such as pressure air or detonation gas, is forced into the first pressure chamber 7 via the supply openings 5 and via the channel 15 partly via the throttled gas connection 16 to the second pressure chamber, partly unthrottled into the third pressure chamber 18. When the pressure in the second pressure chamber 18 has risen so much that the pressure force acting on the first piston 8 has become sufficiently high for the shear pin 17 to be sheared off, the first piston 8 with the load 10 is released for an axial movement out of the casing 2. During this movement the dowel 24 remains in its radial position until its outer end 27 is outside the casing 2. At this moment it is expelled outwards due to the radial force that the conical point 23 of the striking pin 22 exerts on the dowel. Thereby the axial movement of the second piston 20 relative to the first piston 8 is released due to the gas pressure in the third pressure chamber, so that the striking pin 22 activates the igniting element 11 and thereby ignites the pyrotechnic charge 10. This cannot occur until the moment of firing, when the third pressure chamber is set under pressure and not until the pyrotechnic charge 10 is located outside the casing 2, because the first locking means, i.e. the dowel 24, is locked in its radial movement by the casing 2 until the load is located entirely outside the casing.

I claim:

1. A projectile for the dispersal of a load in the form of a pyrotechnic charge (10) with a predetermined time delay after firing of the projectile from a launching tube (1) with gas under pressure, comprising a cylindrical casing (2) with a first pressure chamber (7) formed by a first portion of the casing (2), a cross wall (3) arranged in the casing and an external side wall (4) provided with at least one supply opening (5) for said gas to the first pressure chamber (7), further comprising a second pressure chamber (9) formed by a second portion of the casing (2), said cross wall (3) and first piston (8) axially movable with slide fitting in the casing, further comprising said load (10) standing in connection with the first piston (8), a throttled gas connection (16) being arranged between the first and second pressure chambers (7, 9), the piston (8), under the effect of a pressure built up in the second pressure chamber (9), being arranged to perform an axial movement, expelling the load (10) out of the casing (2), but not until the pressure has reached a predetermined level, characterized in that a third pressure chamber (18) standing in gas connection with the first pressure chamber (7) is arranged in the first piston (8) formed by a barrel (21) in which a second piston (20) is arranged movable with slide fitting, provided with a striking pin (22) intended to activate an igniting element (11) for igniting the charge (10), a first locking element (24) being arranged to detend the second piston (20) against movement for as long as the movement of the first locking element (24) is detended by said casing (2).

* * * * *